United States Patent [19]

Peilet

[11] 4,162,554

[45] Jul. 31, 1979

[54] RETRACTABLE BRUSH WITH RESISTANCE TO POPPING APART

[76] Inventor: Lester R. Peilet, 6144 N. Talman Ave., Chicago, Ill. 60659

[21] Appl. No.: 859,029

[22] Filed: Dec. 9, 1977

[51] Int. Cl.[2] ..... A46B 9/10; A46B 15/00; A46B 17/06

[52] U.S. Cl. ..... 15/184; 15/104.5; 132/119

[58] Field of Search ..... 15/104.5-104.55, 15/114, 169, 184; 132/119-123; 401/112, 116; 220/253, 306

[56] References Cited

U.S. PATENT DOCUMENTS

| | | | |
|---|---|---|---|
| 2,549,681 | 4/1951 | Goldstaub | 220/253 X |
| 2,865,039 | 12/1958 | Kaye et al. | 15/169 X |
| 2,916,757 | 12/1959 | Peilet et al. | 15/184 |
| 3,059,259 | 10/1962 | Peilet et al. | 15/184 |
| 3,484,015 | 12/1969 | Rowen | 220/306 |
| 4,001,910 | 1/1977 | Peilet | 15/184 |

FOREIGN PATENT DOCUMENTS

| | | | |
|---|---|---|---|
| 36787 | 2/1965 | German Democratic Rep. | 220/253 |
| 506428 | 5/1939 | United Kingdom | 15/184 |

*Primary Examiner*—Peter Feldman

*Attorney, Agent, or Firm*—Burmeister, York, Palmatier, Hamby & Jones

[57] ABSTRACT

The disclosed retractable brush comprises a casing made of a resilient plastic material and having generally cup shaped front and rear members which are relatively rotatable, said front member having a front wall and an annular generally cylindrical side wall projecting rearwardly therefrom, said front wall having a plurality of bristle receiving openings therein, said rear member having a rear wall with an annular generally cylindrical side wall projecting forwardly therefrom, a bristle carrying member movable in said casing and having bristles movable outwardly and retractable rearwardly through said openings, and operating means in said casing for advancing and retracting said bristle carrying member in response to relative rotation of said front and rear members in opposite directions, said annular side wall of said front member having an internal inwardly projecting annular lip thereon and an internal annular groove therein immediately in front of said annular lip, said annular side wall of said rear member having an external annular lip projecting outwardly therefrom and slidably received in said internal groove, said internal annular lip interlocking with said external annular lip and slidably engaging said annular side wall of said rear member immediately to the rear of said external annular lip, said internal and external annular lips overlapping substantially when assembled and being dimensioned for assembly by snapping together under heavy manual pressure, said annular lips and said annular groove interlocking with a snug sliding fit therebetween and without any looseness for largely obviating any accidental disconnection of said internal and external annular lips due to gripping pressure on said casing.

4 Claims, 5 Drawing Figures

FIG. 5
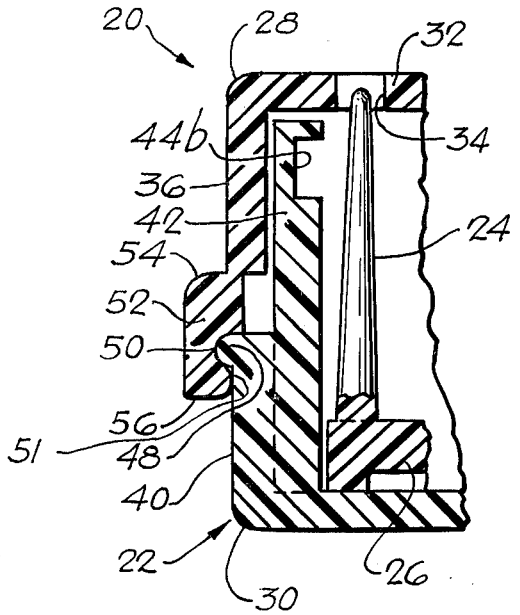
FIG. 1
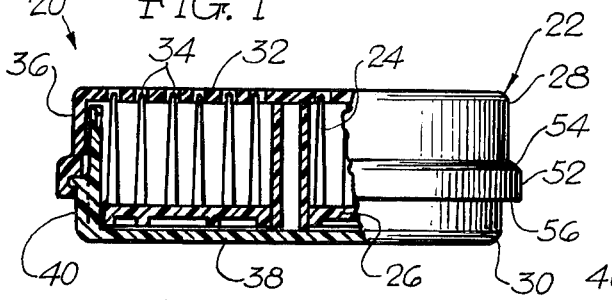
FIG. 2
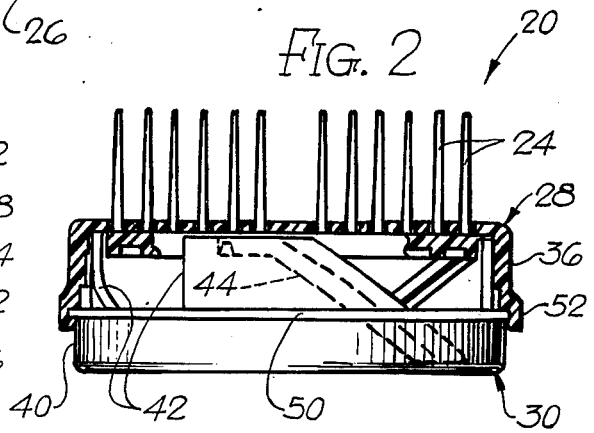
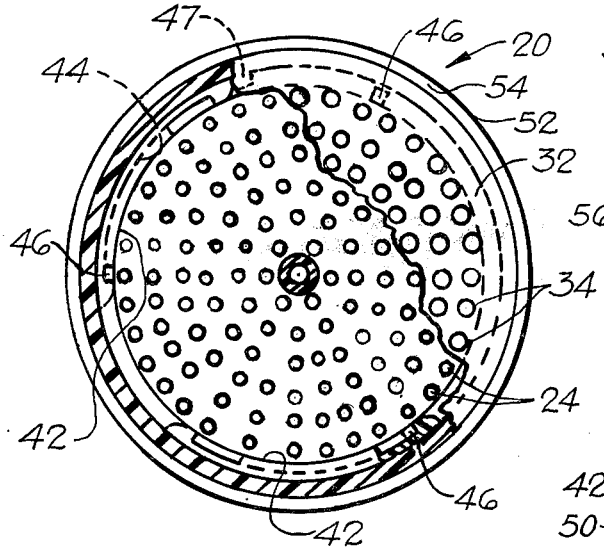
FIG. 3
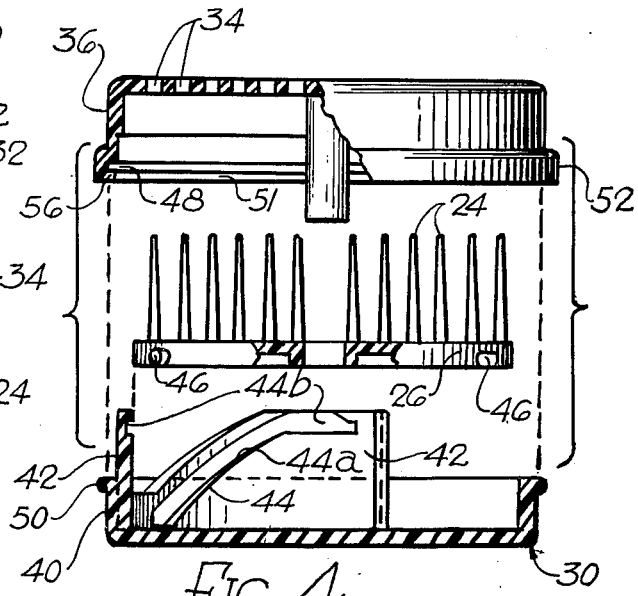
FIG. 4

RETRACTABLE BRUSH WITH RESISTANCE TO POPPING APART

This invention relates to a retractable brush of the type having bristles which are adapted to be retracted into and extended out of a casing, through openings in the front wall of the casing. Such brushes have the advantage of being highly compact when the bristles are retracted. Moreover, such brushes are self-cleaning, in that hair and other foreign particles are stripped from the bristles as they are retracted into the casing.

More particularly, the present invention relates to a retractable brush having a casing comprising cup shaped front and rear members which snap together and are relatively rotatable so that the front and rear members can be employed to operate an internal mechanism whereby the bristles can be extended and retracted by producing relative rotation of the front and rear members in opposite directions.

In some cases, a difficulty has arisen with brushes of this character, in that gripping pressure on the casing sometimes causes the front and rear members to pop apart accidentally, so that the retractable brush becomes disassembled.

One principal object of the present invention is to provide a new and improved retractable brush of the foregoing character, having resistance to popping apart accidentally.

To achieve this objective, the present invention preferably provides a retractable brush comprising a casing made of a resilient resinous plastic material and having generally cup shaped front and rear members which are relatively rotatable, the front member having a front wall and an annular generally cylindrical side wall projecting rearwardly therefrom, the front wall having a plurality of bristle receiving openings therein, the rear member having a rear wall with an annular generally cylindrical side wall projecting forwardly therefrom, a bristle carrying member movable in the casing and having bristles movable outwardly and retractable rearwardly through the openings, and operating means in the casing for advancing and retracting the bristle carrying member in response to relative rotation of the front and rear members in opposite directions, the annular side wall of the front member having an internal inwardly projecting annular lip thereon and an internal annular groove therein immediately in front of the annular lip, the annular side wall of the rear member having an external annular lip projecting outwardly therefrom and slidably received in the internal groove, the internal and external annular lips overlapping substantially when assembled and being dimensioned for assembly by snapping together under heavy manual pressure, the annular lips and the annular groove interlocking with a snug sliding fit therebetween and without any looseness for largely obviating any accidental disconnection of the internal and external annular lips due to gripping pressure on the casing.

In some cases, there can be a reversal of parts, in that the internal annular lip can be on the rear side wall, while the external annular lip is on the front side wall. The annular groove can be on either side wall, immediately adjacent the lip thereon, for slidably receiving the lip on the other side wall.

Further objects, advantages and features of the present invention will appear from the following description, taken with the accompanying drawings, in which:

FIG. 1 is a side view of a retractable brush to be described as an illustrative embodiment of the present invention, the brush being shown in its retracted position and partly in section.

FIG. 2 is a side view, partly in section, showing the retractable brush with its bristles extended.

FIG. 3 is a front view of the brush, partly in section, and with a portion of the front casing member broken away.

FIG. 4 is a disassembled or exploded side view, with portions in section and broken away.

FIG. 5 is a greatly enlarged fragmentary section, corresponding to a portion of FIG. 1.

As indicated above, FIGS. 1-5 illustrate a retractable brush 20 to be described as an illustrative embodiment of the present invention. The illustrated brush 20 comprises a body or casing 22, into which bristles 24 are retractable, as shown in FIG. 1. The bristles 24 are adapted to be extended out of the casing 22, as shown in FIG. 2. It will be seen that the bristles 24 are carried by a bristle carrying member 26 which is movable within the casing 22.

Bristles of any suitable type may be employed. Thus, the bristles may be of the tufted type, arranged in tufts, each containing a multiplicity of bristles, mounted on the bristle carrying member. However, in this case, the bristles 24 are of the individual or single type, which may be molded in one piece with the bristle carrying member 26, from a suitable flexible material, such as polyethylene, polypropylene or some other resinous plastic material, for example.

The illustrated casing 22 comprises front and rear members 28 and 30. In this case, the front member 28 is generally cup shaped and comprises a front wall 32 having openings 34 therein, through which the bristles 24 are adapted to be extended and retracted. The illustrated front member 28 also has an annular side wall 36 extending rearwardly from the front wall 32. The side wall 36 may be generally cylindrical in shape. The front member 28 may be molded from a suitable resinous plastic material, such as polyethylene or polypropylene, for example.

In this case, the rear member 30 is also generally cup shaped and comprises a rear wall 38 and an annular side wall 40 projecting forwardly therefrom, the side wall 40 being generally cylindrical in shape. The rear member 30 may also be molded from a suitable plastic material, as in the case of the front member 28.

Various means may be employed to provide for the extension and retraction of the bristles 24. In this case, the movement of the bristles 24 is brought about by relative rotation between the front and rear members 28 and 30 of the casing 22. Thus, the front member 28 may be held in one hand, while the rear member 30 is rotated to produce the extension and retraction of the bristles 24. Rotation of the rear member 30 in one direction produces extension of the bristles 24. Retraction of the bristles is produced by rotation of the rear member 30 in the opposite direction. The front and rear members 28 and 30 are held together for relative rotation in a manner to be described presently.

In the illustrated brush construction, the reception of the bristles 24 in the openings 34 prevents any relative rotation between the bristle carrying member 26 and the front casing member 28. The rear casing member 30 includes means for converting the rotation of the rear member 30 into forward and rearward movement of the bristle carrying member 26. Such conversion may be brought about by various mechanisms, such as the illustrated cam members 42 projecting forwardly on side wall 40 of the rear member 30. The illustrated brush 20 comprises three such cam members 42, each formed with a cam track or groove 44, as shown most clearly in FIGS. 2 and 4. The bristle carrying member 26 preferably comprises tabs or followers 46 which engage and follow the cam tracks 44. The illustrated followers 46 project outwardly from the bristle carrying member 26, which is generally circular in shape. Each of the illustrated cam tracks 44 has an inclined portion **44*a* and a level front portion 44*b* which retains the bristle carrying member 26 in its extended position. The cam members 42 are preferably molded in one piece with the rear casing member 30**.

When the rear casing member 30 is rotated in one direction, relative to the front casing member 28, to extend the bristles 24, the tabs or followers 46 are pushed forwardly by the cam tracks 44, until the tabs 46 enter the level front portions **44*b* of the tracks. The rotation of the rear casing member 30 may be limited by the engagement of the tabs with the extreme ends of the level track portions 44*b***.

When the rear casing member 30 is rotated in the opposite direction, the cam tracks 44 push the tabs or followers 46 rearwardly. The rotation may be limited by providing a stop 47, projecting inwardly from the front casing member 28 for engaging with one of the cam members 42, as shown in FIG. 3.

Means are provided to hold the front and rear casing members 28 and 30 together, while providing for relative rotation of the members. Such means are arranged so that the front and rear members 28 and 30 can be assembled by pushing them together, without the use of any extra fasteners.

As shown most clearly in FIGS. 4 and 5, the annular side walls 36 and 40 of the front and rear members 28 and 30 are preferably formed with annular detent elements, which preferably take the form of annular lips on both of the side walls, and an annular groove in at least one of the side walls. In the illustrated construction, the side wall 36 of the front member 28 is formed with an internal annular groove 48, adapted to receive an external outwardly projecting lip or ridge 50 on the side wall 40 of the rear casing member 30. The front side wall 36 is preferably formed with an internal annular inwardly projecting lip 51, adapted to interlock with the external lip 50. The casing members 28 and 30 are sufficiently flexible and resilient to allow the external lip 50 to be snapped past the internal lip 51 and into the groove 48, by pushing the members 28 and 30 together, with a heavy manual pressure.

The annular groove 48 is preferably formed within an enlarged rear portion 52 of the front side wall 36. The enlarged portion 52 provides circumferential shoulders 54 and 56, facing in opposite directions. Such shoulders are useful in packaging the brush 20 on a display card or the like, in that the shoulders will retain the brush in circular holes formed in the panels of a folded display card. The panels can then be stapled or otherwise fastened together to retain the brush on the card.

In order to prevent the front and rear casing members 28 and 30 from popping apart accidentally, the external and internal annular lips 50 and 51 are dimensioned and positioned so as to interlock and overlap substantially, when the lips are in their assembled relation. Moreover, the lips 50 and 51 are dimensioned for assembly by snapping them together under heavy manual pressure. Moreover, the annular lips 50 and 51 and the annular groove 48 are positioned, dimensioned and shaped so as to interlock with a snug sliding fit therebetween and without any looseness or play. These features give the retractable brush 20 a high degree of resistance to popping apart accidentally, due to gripping pressure on the side walls of the casing. Such gripping pressure, particularly when applied to the enlarged portion 52 of the front side wall 36, tends to distort the circular side walls 36 and 40 into an oval shape, with the result that the external and internal lips 50 and 51 tend to pop apart, if the gripping pressure is large enough.

Still greater resistance to popping apart is provided by arranging the internal annular lip 51 so that it slidably engages the annular side wall 40 of the rear casing member 30, immediately to the rear of the external annular lip 50. Here again, a snug sliding fit should be employed, without any looseness.

It will be understood that various reversals of parts are possible. Thus, the internal and external annular lips may be reversed between the front and rear side walls. Moreover, the annular groove may be either internal or external and may be on either the front or rear side wall.

The present invention provides great resistance to popping apart, so that popping apart of the front and rear casing members is largely obviated and will not occur due to normal gripping pressure or due to rough handling in the shipping of the brushes. Such popping apart is undesirable, because it results in accidental disassembly of the tractable brush. By largely obviating the problem of accidental popping apart, the present invention greatly increases the value of the retractable brush.

I claim:

1. A retractable brush, comprising a casing made of a resilient plastic material and having generally cup shaped front and rear members which are relatively rotatable, said front member having a front wall and an annular generally cylindrical side wall projecting rearwardly therefrom, said front wall having a plurality of bristle receiving openings therein, said rear member having a rear wall with an annular generally cylindrical side wall projecting forwardly therefrom, a bristle carrying member movable in said casing and having bristles movable outwardly and retractable rearwardly through said openings, and operating means in said casing for advancing and retracting said bristle carrying member in response to relative rotation of said front and rear members in opposite directions, said annular side wall of said front member having a continuously circular internal inwardly projecting annular lip thereon and an internal annular groove therein immediately in front of said annular lip, said annular side wall of said rear member having a continuously circular external annular lip projecting outwardly therefrom and slidably received in said internal groove, said internal annular lip interlocking with said external annular lip and slidably engaging said annular side wall of said rear member immediately to the rear of said external annular lip, said internal and external annular lips overlapping substantially when assembled and being dimensioned for assembly by snapping together under heavy manual pressure, said annular lips and said annular groove interlocking with a snug sliding fit therebetween and without any looseness for largely obviating any accidental disconnection of said internal and external annular lips due to gripping pressure on said casing or due to rough handling during shipment.

2. A retractable brush, comprising a casing made of a resilient plastic material and having generally cup shaped front and rear members which are relatively rotatable, said front member having a front wall and an annular generally cylindrical side wall projecting rearwardly therefrom, said front wall having a plurality of bristle receiving openings therein, said rear member having a rear wall with an annular generally cylindrical side wall projecting forwardly therefrom, a bristle carrying member movable in said casing and having bristles movable outwardly and retractable rearwardly through said openings, and operating means in said casing for advancing and retracting said bristle carrying member in response to relative rotation of said front and rear members in opposite directions, said annular side wall of said front member having a continuously circular internal inwardly projecting annular lip thereon and an internal annular groove therein immediately in front of said annular lip, said annular side wall of said rear member having a continuously circular external annular lip projecting outwardly therefrom and slidably received in said internal groove, said internal and external annular lips overlapping substantially when assembled and being dimensioned for assembly by snapping together under heavy manual pressure, said annular lips and said annular groove interlocking with a snug sliding fit therebetween and without any looseness for largely obviating any accidental disconnection of said internal and external annular lips due to gripping pressure on said casing.

3. A retractable brush, comprising a casing made of a resilient plastic material and having generally cup shaped front and rear members which are relatively rotatable, said front member having a front wall and an annular generally cylindrical side wall projecting rearwardly therefrom, said front wall having a plurality of bristle receiving openings therein, said rear member having a rear wall with an annular generally cylindrical side wall projecting forwardly therefrom, a bristle carrying member movable in said casing and having bristles movable outwardly and retractable rearwardly through said openings, and operating means in said casing for advancing and retracting said bristle carrying member in response to relative rotation of said front and rear members in opposite directions, said annular side wall of one of said members having a continuously circular internal inwardly projecting annular lip thereon and an internal annular groove therein immediately adjacent said annular lip, said annular side wall of the other of said members having a continuously circular external annular lip projecting outwardly therefrom and slidably received in said internal groove, said internal and external annular lips overlapping substantially when assembled and being dimensioned for assembly by snapping together under heavy manual pressure, said annular lips and said annular groove interlocking with a snug sliding fit therebetween and without any looseness for largely obviating any accidental disconnection of said internal and external annular lips due to gripping pressure on said casing.

4. A retractable brush, comprising a casing made of a resilient plastic material and having generally cup shaped front and rear members which are relatively rotatable, said front member having a front wall and an annular generally cylindrical side wall projecting rearwardly therefrom, said front wall having a plurality of bristle receiving openings therein, said rear member having a rear wall with an annular generally cylindrical side wall projecting forwardly therefrom, a bristle carrying member movable in said casing and having bristles movable outwardly and retractable rearwardly through said openings, and operating means in said casing for advancing and retracting said bristle carrying member in response to relative rotation of said front and rear members in opposite directions, said annular side wall of one of said members having a continuously circular internal inwardly projecting annular lip thereon, said annular side wall of the other of said members having a continuously circular external annular lip projecting outwardly therefrom and slidably interlocking with said internal annular lip, one of said side walls having an annular groove therein immediately adjacent said annular lip thereon and slidably receiving said other annular lip, said internal and external annular lips overlapping substantially when assembled and being dimensioned for assembly by snapping together under heavy manual pressure, said annular lips and said annular groove interlocking with a snug sliding fit therebetween and without any looseness for largely obviating any accidental disconnection of said internal and external annular lips due to gripping pressure on said casing.

* * * * *